US009249764B2

(12) United States Patent
Wiggins et al.

(10) Patent No.: US 9,249,764 B2
(45) Date of Patent: Feb. 2, 2016

(54) ENGINE CONTROL SYSTEMS AND METHODS WITH HUMIDITY SENSORS

(75) Inventors: Layne K. Wiggins, Dexter, MI (US); Martin Leven, West Bloomfield, MI (US); Wajdi B. Hamama, Whitmore Lake, MI (US); Kauser Ferdous, West Bloomfield, MI (US); Robert Domino, Livonia, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 701 days.

(21) Appl. No.: 13/490,821

(22) Filed: Jun. 7, 2012

(65) Prior Publication Data

US 2013/0238218 A1 Sep. 12, 2013

Related U.S. Application Data

(60) Provisional application No. 61/607,078, filed on Mar. 6, 2012.

(51) Int. Cl.

| | |
|---|---|
| ***F02M 35/10*** | (2006.01) |
| ***F02D 41/06*** | (2006.01) |
| *F02D 13/02* | (2006.01) |
| *F02D 41/04* | (2006.01) |

(Continued)

(52) U.S. Cl.

CPC ..... *F02M 35/10393* (2013.01); *F02D 41/065* (2013.01); *F02D 13/0219* (2013.01); *F02D 41/042* (2013.01); *F02D 41/18* (2013.01); *F02D 2041/001* (2013.01); *F02D 2200/0418* (2013.01); *F02P 5/15* (2013.01)

(58) Field of Classification Search

CPC ..... F02D 2041/1472; F02D 2200/0418

USPC ..... 701/102, 101, 103; 123/179.4, 568, 123/470, 481, 198 DB, 198 F, 491, 493, 123/179.3; 73/114.31, 114.32

See application file for complete search history.

(56) References Cited

U.S. PATENT DOCUMENTS

| | | | |
|---|---|---|---|
| 4,081,725 | A | 3/1978 | Schmidt et al. |
| 4,404,946 | A | 9/1983 | Hoard et al. |

(Continued)

FOREIGN PATENT DOCUMENTS

| | | | |
|---|---|---|---|
| CN | 101988432 | A | 3/2011 |
| CN | 202510230 | U | 10/2012 |

(Continued)

OTHER PUBLICATIONS

U.S. Appl. No. 13/490,885, filed Jun. 7, 2012, Song et al.

(Continued)

*Primary Examiner* — Hai Huynh
*Assistant Examiner* — Raza Najmuddin

(57) ABSTRACT

A system for a vehicle includes a humidity determination module, a specific humidity module, and a parameter control module. The humidity determination module determines a first specific humidity of air based on a relative humidity of the air measured by a humidity sensor in an intake system of the vehicle. The specific humidity module sets a second specific humidity of the air equal to one of the first specific humidity and a predetermined specific humidity of the air in response to a comparison of a mass air flowrate (MAF) into an engine and a predetermined flowrate. The parameter control module controls at least one operating parameter of an engine based on the second specific humidity.

20 Claims, 4 Drawing Sheets

(51) Int. Cl.

| | |
|---|---|
| *F02D 41/18* | (2006.01) |
| *F02P 5/15* | (2006.01) |
| *F02D 41/00* | (2006.01) |

(56) References Cited

U.S. PATENT DOCUMENTS

| | | | | |
|---|---|---|---|---|
| 4,790,286 | A | 12/1988 | Nishida et al. | |
| 4,836,174 | A | 6/1989 | Chujo et al. | |
| 4,905,654 | A | 3/1990 | Katsuno et al. | |
| 4,942,860 | A | 7/1990 | Chujo et al. | |
| 4,990,235 | A | 2/1991 | Chujo | |
| 5,034,112 | A | 7/1991 | Murase et al. | |
| 5,190,017 | A | 3/1993 | Cullen et al. | |
| 5,205,260 | A | 4/1993 | Takahashi et al. | |
| 5,207,093 | A | 5/1993 | Maeda | |
| 5,465,617 | A | 11/1995 | Dudek et al. | |
| 5,540,091 | A | 7/1996 | Nakagawa | |
| 5,617,337 | A | 4/1997 | Eidler et al. | |
| 5,639,961 | A | 6/1997 | Lautenschutz | |
| 5,685,284 | A | 11/1997 | Nakamichi | |
| 6,000,385 | A | 12/1999 | Fukuma | |
| 6,029,451 | A | 2/2000 | Gartner | |
| 6,164,270 | A | 12/2000 | Bidner et al. | |
| 6,240,365 | B1 | 5/2001 | Bunn | |
| 6,309,534 | B1 | 10/2001 | Fray et al. | |
| 6,311,679 | B1 | 11/2001 | Druzhinina et al. | |
| 6,405,106 | B1 | 6/2002 | Sheth et al. | |
| 6,516,656 | B1 | 2/2003 | Jetter et al. | |
| 6,575,148 | B1 * | 6/2003 | Bhargava et al. | 123/564 |
| 6,581,370 | B2 | 6/2003 | Sato et al. | |
| 6,711,892 | B2 | 3/2004 | Tamura et al. | |
| 6,732,031 | B1 | 5/2004 | Lightner et al. | |
| 6,738,697 | B2 | 5/2004 | Breed | |
| 6,739,177 | B2 | 5/2004 | Sato et al. | |
| 6,772,586 | B2 | 8/2004 | Miyahara et al. | |
| 6,802,302 | B1 | 10/2004 | Li et al. | |
| 6,817,197 | B1 * | 11/2004 | Padfield | 62/176.6 |
| 7,016,779 | B2 | 3/2006 | Bowyer | |
| 7,104,259 | B2 | 9/2006 | Terada | |
| 7,155,332 | B2 | 12/2006 | Yamada et al. | |
| 7,181,335 | B2 | 2/2007 | Barba et al. | |
| 7,195,009 | B2 | 3/2007 | Cullen | |
| 7,254,477 | B1 | 8/2007 | Banks | |
| 7,261,098 | B2 | 8/2007 | Vigild et al. | |
| 7,267,117 | B2 | 9/2007 | Tonetti et al. | |
| 7,318,409 | B2 | 1/2008 | Cullen | |
| 7,398,775 | B2 | 7/2008 | Cullen | |
| 7,400,967 | B2 | 7/2008 | Ueno et al. | |
| 7,409,275 | B2 | 8/2008 | Sakurai et al. | |
| 7,463,960 | B2 | 12/2008 | Thiel et al. | |
| 7,474,954 | B1 | 1/2009 | Zagone | |
| 7,526,950 | B2 | 5/2009 | Van Nieuwstadt et al. | |
| 7,532,963 | B1 | 5/2009 | Lowrey et al. | |
| 7,565,901 | B2 | 7/2009 | Furuta et al. | |
| 7,620,490 | B2 | 11/2009 | Matsunaga | |
| 7,650,211 | B2 | 1/2010 | Wang et al. | |
| 7,654,253 | B2 | 2/2010 | Cullen | |
| 7,715,976 | B1 | 5/2010 | Xiao et al. | |
| 7,974,749 | B2 | 7/2011 | Zettel et al. | |
| 8,042,528 | B2 | 10/2011 | Gates et al. | |
| 8,127,816 | B2 | 3/2012 | Gnan | |
| 8,315,759 | B2 | 11/2012 | Bauerle | |
| 8,521,354 | B2 | 8/2013 | Sasaki | |
| 8,543,317 | B2 * | 9/2013 | Pasero | F02D 41/005 123/568.22 |
| 8,733,081 | B2 | 5/2014 | Miyashita | |
| 9,080,528 | B2 | 7/2015 | Aoyagi | |
| 2002/0066442 | A1 | 6/2002 | Muller et al. | |
| 2002/0139360 | A1 | 10/2002 | Sato et al. | |
| 2003/0106367 | A1 | 6/2003 | Osaki et al. | |
| 2003/0115854 | A1 | 6/2003 | Tamura et al. | |
| 2003/0159521 | A1 * | 8/2003 | Sarholz et al. | 73/861.03 |
| 2004/0061290 | A1 | 4/2004 | Gray | |
| 2004/0079332 | A1 | 4/2004 | Kotwicki | |
| 2004/0230345 | A1 | 11/2004 | Tzamaloukas | |
| 2005/0072411 | A1 | 4/2005 | Cullen | |
| 2005/0131620 | A1 | 6/2005 | Bowyer | |
| 2005/0139193 | A1 | 6/2005 | Kobayashi et al. | |
| 2005/0161029 | A1 | 7/2005 | Ishikawa | |
| 2005/0274369 | A1 | 12/2005 | Tonetti et al. | |
| 2006/0048760 | A1 | 3/2006 | Matsunaga et al. | |
| 2006/0064228 | A1 | 3/2006 | Huang | |
| 2006/0213490 | A1 | 9/2006 | Vigild et al. | |
| 2007/0005609 | A1 | 1/2007 | Breed | |
| 2007/0062499 | A1 | 3/2007 | Miyasako et al. | |
| 2007/0100519 | A1 | 5/2007 | Engel | |
| 2007/0174003 | A1 | 7/2007 | Ueno et al. | |
| 2007/0181111 | A1 | 8/2007 | Cullen | |
| 2008/0178853 | A1 | 7/2008 | Yamaoka et al. | |
| 2008/0189009 | A1 | 8/2008 | Wang et al. | |
| 2008/0270012 | A1 | 10/2008 | Cullen | |
| 2008/0316006 | A1 | 12/2008 | Bauman et al. | |
| 2009/0038308 | A1 | 2/2009 | Nagae | |
| 2009/0132153 | A1 | 5/2009 | Shutty et al. | |
| 2009/0254245 | A1 | 10/2009 | Bauerle | |
| 2010/0042284 | A1 | 2/2010 | Sasaki | |
| 2010/0185379 | A1 | 7/2010 | Burkhardt et al. | |
| 2010/0224174 | A1 | 9/2010 | Tabata | |
| 2010/0307140 | A1 | 12/2010 | Viola et al. | |
| 2011/0011378 | A1 | 1/2011 | Nakamura | |
| 2011/0023847 | A1 | 2/2011 | Gates et al. | |
| 2011/0054762 | A1 | 3/2011 | Nakayama et al. | |
| 2011/0072793 | A1 | 3/2011 | Bidner et al. | |
| 2011/0073086 | A1 | 3/2011 | Bahlo et al. | |
| 2011/0077838 | A1 | 3/2011 | Osburn et al. | |
| 2011/0191010 | A1 | 8/2011 | Russ et al. | |
| 2012/0046854 | A1 | 2/2012 | Sangkyu et al. | |
| 2012/0116648 | A1 | 5/2012 | Russ et al. | |
| 2012/0227714 | A1 * | 9/2012 | Surnilla et al. | 123/568.19 |
| 2012/0227719 | A1 * | 9/2012 | Surnilla et al. | 123/676 |
| 2012/0247439 | A1 | 10/2012 | Ramappan et al. | |
| 2012/0303346 | A1 | 11/2012 | Takezoe et al. | |
| 2013/0054122 | A1 | 2/2013 | Aoyagi | |
| 2013/0073179 | A1 | 3/2013 | Song et al. | |
| 2013/0199177 | A1 | 8/2013 | Holberg et al. | |
| 2013/0226435 | A1 | 8/2013 | Wasberg et al. | |
| 2013/0253798 | A1 | 9/2013 | Ramappan et al. | |
| 2013/0253802 | A1 | 9/2013 | Miyamoto et al. | |
| 2013/0268176 | A1 | 10/2013 | Song et al. | |
| 2013/0332050 | A1 | 12/2013 | Song et al. | |
| 2014/0149015 | A1 * | 5/2014 | Pursifull | 701/101 |

FOREIGN PATENT DOCUMENTS

| | | | |
|---|---|---|---|
| EP | 1481295 | A1 | 12/2004 |
| JP | 63140856 | A | 6/1988 |
| JP | 63159664 | A | 7/1988 |
| JP | 405118246 | | 5/1993 |
| JP | 2003148258 | A | 5/2003 |
| JP | 2006029084 | A | 2/2006 |
| JP | 2008087480 | A | 4/2008 |
| JP | 2008248888 | A | 10/2008 |
| JP | 2009243283 | A | 10/2009 |
| JP | 2009287491 | A | 12/2009 |
| JP | 2010203281 | A | 9/2010 |
| WO | WO-03065135 | A1 | 7/2003 |
| WO | WO-2004027244 | A1 | 4/2004 |
| WO | WO-2009118605 | A1 | 10/2009 |
| WO | WO-2011145223 | A1 | 11/2011 |

OTHER PUBLICATIONS

U.S. Appl. No. 13/786,944, filed Mar. 6, 2013, Naik et al.
U.S. Appl. No. 13/967,591, filed Aug. 15, 2013, B. Jerry Song.
U.S. Appl. No. 13/967,660, filed Aug. 15, 2013, B. Jerry Song.
U.S. Appl. No. 13/238,460, filed Sep. 21, 2011, Song et al.
U.S. Appl. No. 13/408,577, filed Feb. 29, 2012, Wasberg et al.
U.S. Appl. No. 13/425,723, filed Mar. 21, 2012, Ramappan et al.
U.S. Appl. No. 13/440,570, filed Apr. 5, 2012, Song et al.

* cited by examiner

ENGINE CONTROL SYSTEMS AND METHODS WITH HUMIDITY SENSORS

CROSS-REFERENCE TO RELATED APPLICATIONS

This application claims the benefit of U.S. Provisional Application No. 61/607,078, filed on Mar. 6, 2012. The disclosure of the above application is incorporated herein by reference in its entirety.

This application is related to U.S. patent application Ser. No. 13/490,885 filed on Jun. 7, 2012. The disclosure of the above application is incorporated herein by reference in its entirety.

FIELD

The present disclosure relates to internal combustion engines and more specifically to engine control systems and methods involving humidity sensors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Air is drawn into an engine through an intake manifold. A throttle valve controls airflow into the engine. The air mixes with fuel from one or more fuel injectors to form an air/fuel mixture. The air/fuel mixture is combusted within one or more cylinders of the engine. Combustion of the air/fuel mixture may be initiated by, for example, injection of the fuel or spark provided by a spark plug.

Combustion of the air/fuel mixture produces torque and exhaust gas. Torque is generated via heat release and expansion during combustion of the air/fuel mixture. The engine transfers torque to a transmission via a crankshaft, and the transmission transfers torque to one or more wheels via a driveline. The exhaust gas is expelled from the cylinders to an exhaust system.

An engine control module (ECM) controls the torque output of the engine. The ECM may control the torque output of the engine based on driver inputs and/or other suitable inputs. The driver inputs may include, for example, accelerator pedal position, brake pedal position, and/or one or more other suitable driver inputs.

SUMMARY

A system for a vehicle includes a humidity determination module, a specific humidity module, and a parameter control module. The humidity determination module determines a first specific humidity of air based on a relative humidity of the air measured by a humidity sensor in an intake system of the vehicle. The specific humidity module sets a second specific humidity of the air equal to one of the first specific humidity and a predetermined specific humidity of the air in response to a comparison of a mass air flowrate (MAF) into an engine and a predetermined flowrate. The parameter control module controls at least one operating parameter of an engine based on the second specific humidity.

A method for a vehicle, includes: determining a first specific humidity of air based on a relative humidity of the air measured by a humidity sensor in an intake system of the vehicle; setting a second specific humidity of the air equal to one of the first specific humidity and a predetermined specific humidity of the air in response to a comparison of a mass air flowrate (MAF) into an engine and a predetermined flowrate; and controlling at least one operating parameter of an engine based on the second specific humidity.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

A humidity sensor measures relative humidity of air within an intake system of an engine. An engine control module (ECM) determines a specific humidity of the air based on the relative humidity. The ECM selectively controls one or more engine operating parameters based on the specific humidity of the air.

Under some circumstances, however, water vapor produced by the engine may be measured by the humidity sensor. For example, water vapor produced by the engine may be measured by the humidity sensor: (i) when airflow into the engine is low; and/or (ii) during a predetermined period following a shutdown of the engine. The specific humidity may therefore be inaccurate based on the water vapor produced by the engine, and the ECM may improperly adjust one or more engine operating parameters based on the inaccuracy of the specific humidity.

Under circumstances where water vapor produced by the engine may be measured by the humidity sensor, the ECM sets the specific humidity equal to a predetermined value of the specific humidity determined before engine produced water vapor was measured by the humidity sensor. For example, when airflow into the engine is low, the ECM selectively sets the specific humidity equal to a specific humidity determined before engine produced water vapor was measured by the humidity sensor. Additionally or alternatively, when the engine is started after being shut down for less than the predetermined period, the ECM sets the specific humidity equal to a specific humidity determined before or at the shutdown of the engine.

Figure 1:
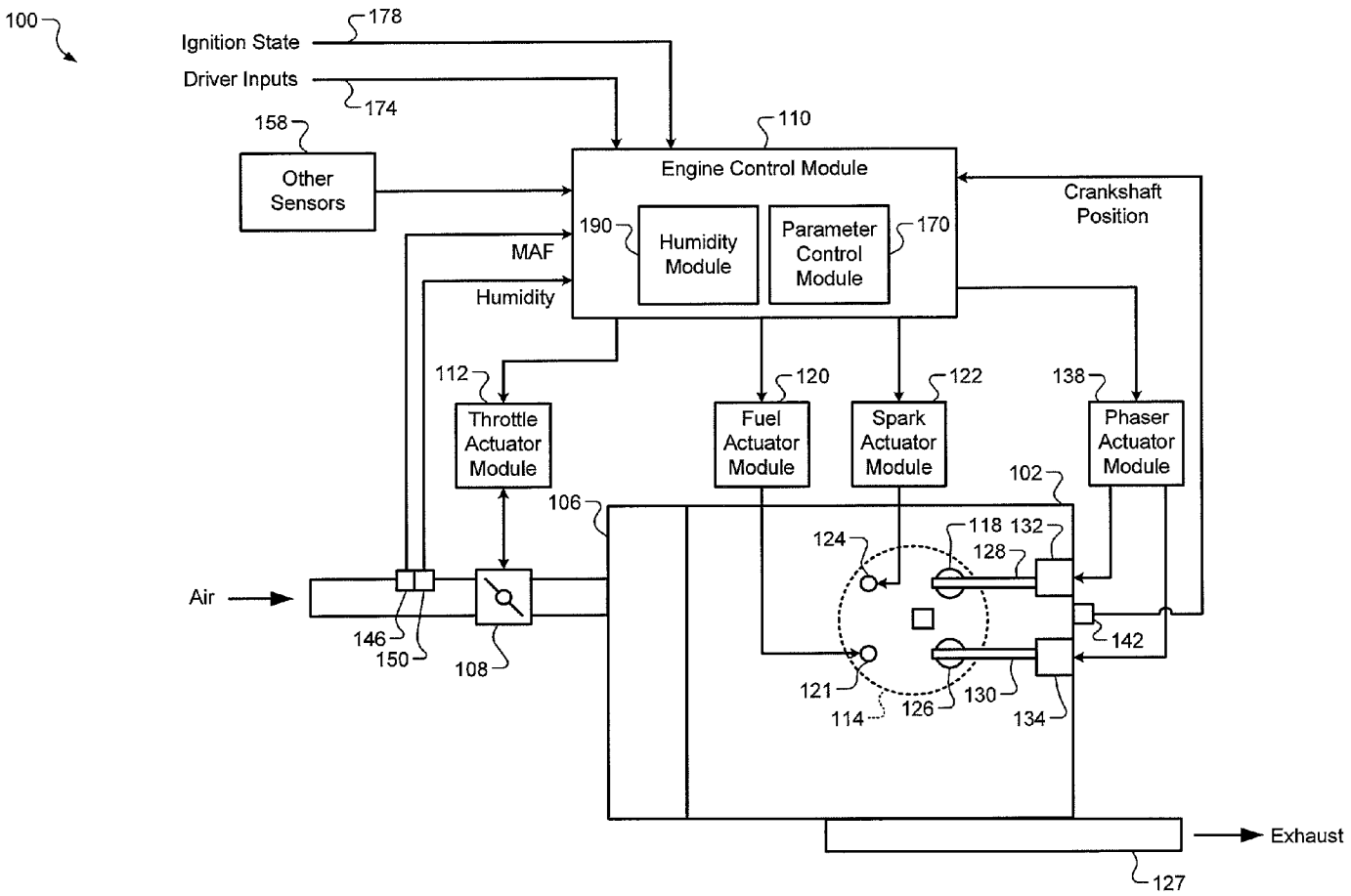
FIG. 1 is a functional block diagram of an example engine system according to the present disclosure.

Referring now to FIG. 1, a functional block diagram of an example engine system 100 is presented. The engine system 100 includes an engine 102 that combusts an air/fuel mixture to produce drive torque for a vehicle. While the engine 102 will be discussed as a spark ignition direct injection (SIDI) engine, the engine 102 may include another suitable type of engine including compression ignition engines. One or more electric motors and/or motor generator units (MGUs) may be used with the engine 102.

Air is drawn into the engine via an intake system. The intake system may include an intake manifold 106 and a throttle valve 108. Air is drawn into the intake manifold 106 through the throttle valve 108. The throttle valve 108 varies airflow into the intake manifold 106. For example only, the throttle valve 108 may include a butterfly valve having a rotatable blade. An engine control module (ECM) 110 controls a throttle actuator module 112 (e.g., an electronic throttle controller or ETC), and the throttle actuator module 112 controls opening of the throttle valve 108.

Air from the intake manifold 106 is drawn into cylinders of the engine 102. While the engine 102 may include more than one cylinder, only a single representative cylinder 114 is shown. Air from the intake manifold 106 is drawn into the cylinder 114 through one or more intake valves, such as intake valve 118.

The ECM 110 controls a fuel actuator module 120, and the fuel actuator module 120 controls opening of a fuel injector 121. The fuel injector 121 injects fuel into the cylinder 114. A fuel injector may be provided for each cylinder of the engine 102. Fuel is provided to the fuel injectors by a low pressure fuel pump and a high pressure fuel pump (not shown). The low pressure fuel pump draws fuel from a fuel tank and provides fuel at low pressures to the high pressure fuel pump. The high pressure fuel pump selectively further pressurizes the fuel, for example, for injection into the cylinders of the engine 102.

The injected fuel mixes with air and creates an air/fuel mixture in the cylinder 114. A piston (not shown) within the cylinder 114 compresses the air/fuel mixture. Based upon a signal from the ECM 110, a spark actuator module 122 energizes a spark plug 124 in the cylinder 114. Spark generated by the spark plug 124 ignites the air/fuel mixture. The timing of the spark may be specified relative to the time when the piston is at its topmost position, referred to as top dead center (TDC). A spark plug may be provided for each cylinder of the engine 102.

The combustion of the air/fuel mixture drives the piston down, and the piston drives rotation of a crankshaft (not shown). After reaching a bottom most position, referred to as bottom dead center (BDC), the piston begins moving up again and expels the byproducts of combustion through one or more exhaust valves, such as exhaust valve 126. The byproducts of combustion are exhausted from the vehicle via an exhaust system 127.

One combustion event, from the standpoint of the cylinder 114, may include two revolutions of the crankshaft (i.e., 720° of crankshaft rotation). One combustion event for the cylinder 114 may include four phases: an intake phase; a compression phase; an expansion phase; and an exhaust phase.

For example only, the piston lowers toward the BDC position and air is drawn into the cylinder 114 during the intake phase. The piston rises toward the TDC position and compresses the contents of the cylinder 114 during the compression phase. Fuel may be injected into the cylinder 114 during the compression phase. Fuel injection may also occur during the expansion phase. Combustion drives the piston toward the BDC position during the expansion phase. The piston rises toward the TDC position to expel the resulting exhaust gas from the cylinder 114 during the exhaust phase. One engine cycle may refer to the period associated with each of the cylinders undergoing one combustion event.

The intake valve 118 may be controlled by an intake camshaft 128, while the exhaust valve 126 may be controlled by an exhaust camshaft 130. In various implementations, multiple intake camshafts may control multiple intake valves per cylinder and/or may control the intake valves of multiple banks of cylinders. Similarly, multiple exhaust camshafts may control multiple exhaust valves per cylinder and/or may control exhaust valves for multiple banks of cylinders.

The time at which the intake valve 118 is opened may be varied with respect to the TDC position by an intake cam phaser 132. The time at which the exhaust valve 126 is opened may be varied with respect to the TDC position by an exhaust cam phaser 134. A phaser actuator module 138 may control the intake cam phaser 132 and the exhaust cam phaser 134 based on signals from the ECM 110.

A crankshaft position sensor 142 monitors rotation of the crankshaft and generates a crankshaft position signal based on the rotation of the crankshaft. For example only, the crankshaft position sensor 142 may include a variable reluctance (VR) sensor or another suitable type of crankshaft position sensor. A position of the crankshaft, an engine speed (e.g., a rotational speed of the crankshaft), an engine acceleration (e.g., an acceleration of the crankshaft), and/or other parameters may be determined based on the crankshaft position signal.

A mass air flowrate (MAF) sensor 146 measures a mass flowrate of air into the engine 102 and generates a MAF signal based on the mass flowrate of air into the engine 102. A humidity sensor 150 measures relative humidity of air and generates a humidity signal based on the relative humidity. The humidity sensor 150 may be implemented, for example, between an air filter (not shown) and the throttle valve 108. While the humidity sensor 150 is shown as being implemented with the MAF sensor 146, the humidity sensor 150 may be implemented in another suitable location in the intake system.

The engine system 100 may also include other sensors 158. For example only, the other sensors 158 may include a manifold absolute pressure (MAP) sensor, an intake air temperature (IAT) sensor, a coolant temperature sensor, oil temperature sensors, cylinder pressure sensors, and/or one or more other suitable sensors.

The ECM 110 includes an parameter control module 170 that controls various engine operating parameters. For example, the parameter control module 170 may determine a desired opening of the throttle valve 108, desired fuel injection amount and timing, a desired spark timing, and desired intake and exhaust cam phaser angles. The throttle actuator module 112 controls opening of the throttle valve 108 based on the desired opening. The fuel actuator module 120 controls the fuel injector 121 based on the desired fuel injection amount and timing. The spark actuator module 122 controls the spark plug 124 based on the desired spark timing. The phaser actuator module 138 controls the intake and exhaust cam phasers 132 and 134 based on the desired intake and exhaust cam phaser angles, respectively. The parameter control module 170 may also control other engine operating parameters, such as valve lift and/or duration, boost provided by a boost device, exhaust gas recirculation (EGR), etc.

The parameter control module 170 may control one or more engine operating parameters based on driver inputs 174. For example only, the driver inputs 174 may include one or more accelerator pedal positions, one or more brake pedal positions, cruise control inputs, and other suitable driver inputs.

An ignition state 178 may be provided to the ECM 110 based on user inputs to an ignition control device, such as an ignition button, an ignition key, etc. The ECM 110 may start the engine 102 and shut down the engine 102 based on the ignition state 178. The ECM 110 may also perform auto-stop/start events between a startup of the engine 102 and a shutdown of the engine 102 performed based on the ignition state 178. An auto-stop/start event may include shutting down the engine 102 when torque output from the engine 102 is not needed and restarting the engine 102 when torque output from the engine 102 may be needed.

The ECM 110 also includes a humidity module 190 that determines a specific humidity of ambient air based on the humidity signal. The parameter control module 170 may selectively adjust one or more engine operating conditions based on the specific humidity. For example, the parameter control module 170 may adjust spark timing, one or more of the desired cam phaser angles, and/or one or more other engine operating parameters based on the specific humidity.

Figure 2:
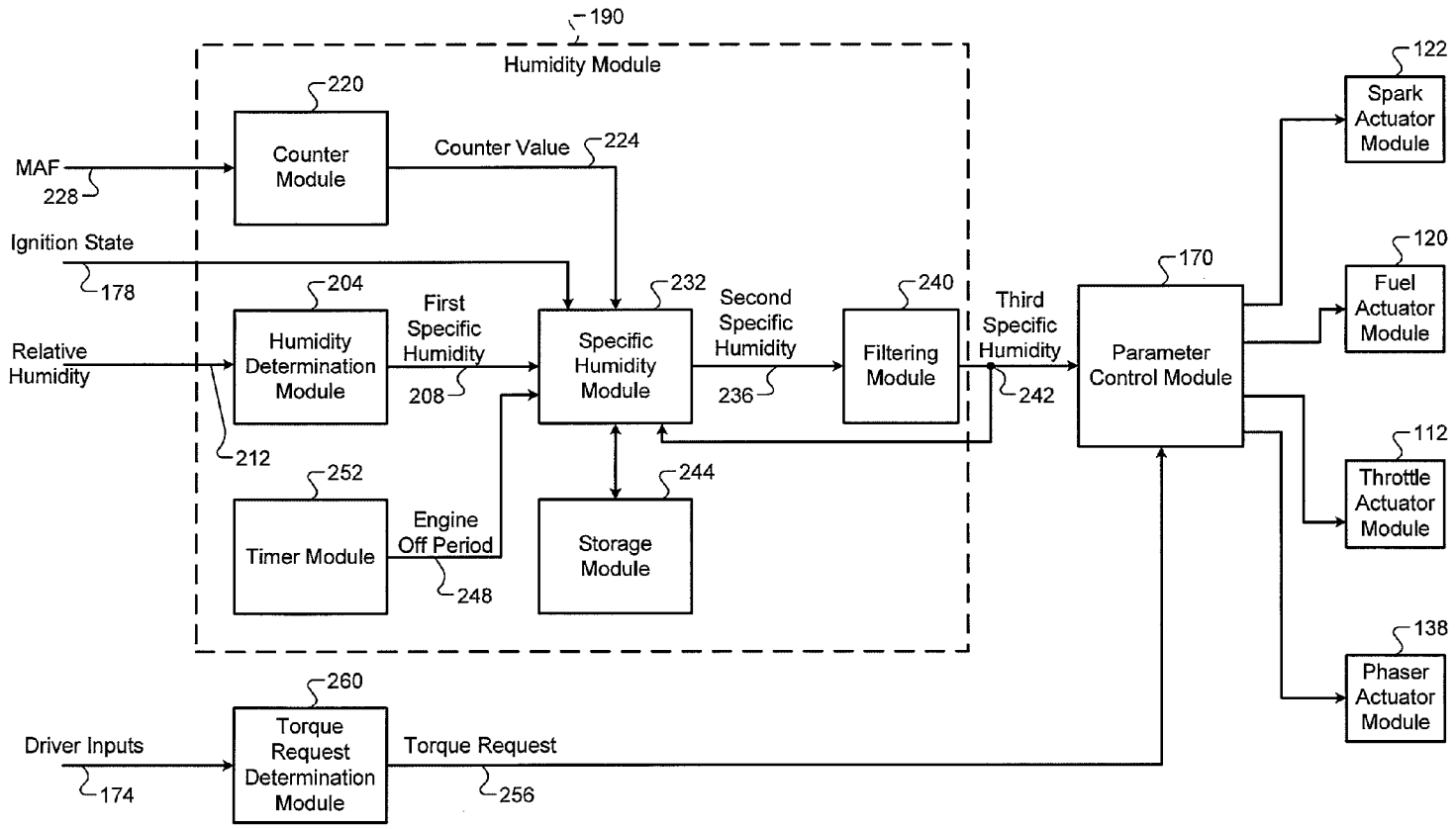
FIG. 2 is a functional block diagram of an example implementation of a humidity module according to the present disclosure.

Referring now to FIG. 2, a functional block diagram of an example implementation of the ECM 110 is presented. A humidity determination module 204 determines a first specific humidity 208 based on a relative humidity 212 measured using the humidity sensor 150. The humidity determination module 204 determines the first specific humidity 208 further based on a pressure at the humidity sensor 150 and a temperature at the humidity sensor 150. The humidity determination module 204 may determine the first specific humidity 208 as a function of the relative humidity 212 and the temperature and the pressure at the humidity sensor 150.

A counter module 220 selectively increments and decrements a counter value 224 based on airflow into the engine 102. The counter module 220 may increment and decrement the counter value 224 by a predetermined amount. For example, the counter module 20 may increment the counter value 224 when airflow into the engine 102 is low and decrement the counter value 224 when airflow into the engine 102 is not low. The counter value 224 corresponds to a period between a first time and a second time when output of the humidity sensor 150 will not reflect water vapor produced by the engine 102 if airflow is not low throughout the period.

Airflow into the engine 102 may be deemed low, for example, when a MAF 228 measured using the MAF sensor 146 is less than a predetermined flowrate. The predetermined flowrate may be calibrated for the engine 102 and may be set, for example, to approximately 5 grams per second (g/s) or another suitable value. In various implementations, airflow into the engine 102 may be deemed low when one or more other suitable conditions are satisfied, such as an engine speed is less than a predetermined speed.

Water vapor produced by the engine 102 may drift toward the humidity sensor 150 when airflow into the engine 102 is low. The amount of water vapor measured by the humidity sensor 150 may increase as the period that airflow into the engine 102 is low increases. Conversely, the amount of water vapor at the humidity sensor 150 may decease when airflow into the engine 102 is not low.

A specific humidity module 232 sets a second specific humidity 236. A filtering module 240 applies a filter to the second specific humidity 236 to produce a third specific humidity 242. The filtering module 240 may adjust the third specific humidity 242 toward the second specific humidity 236 by up to a predetermined amount per predetermined period. In other words, the filtering module 240 may act as a rate limiter in adjusting the third specific humidity 242 toward the second specific humidity 236. The filtering module 240 may apply, for example, a lag filter to the second specific humidity 236 to generate the third specific humidity 242.

When the counter value 224 is less than a predetermined value, the specific humidity module 232 may set the second specific humidity 236 equal to the first specific humidity 208. In this manner, the specific humidity module 232 sets the second specific humidity 236 equal to the first specific humidity 208 at times when water vapor produced by the engine 102 will not affect the output of the humidity sensor 150. The predetermined value may be calibratable and may be set based on a period between a first time when low airflow conditions begin and a second time when water vapor produced by the engine 102 may be measured by the humidity sensor 150 if airflow is low from the first time until the second time.

In response to the counter value 224 transitioning from less than the predetermined value to greater than the predetermined value, the specific humidity module 232 may store the third specific humidity 242. The specific humidity module 232 may store the third specific humidity 242 in a storage module 244 or in another suitable location. In this manner, a specific humidity that is not affected by water vapor produced by the engine 102 is stored.

When the counter value 224 is greater than the predetermined value, the specific humidity module 232 may set the second specific humidity 236 equal to the stored specific humidity. In this manner, the second specific humidity 236 may be set to the last value of the specific humidity determined before water vapor produced by the engine 102 may have begun to affect the first specific humidity 208. The specific humidity module 232 continues to set the second specific humidity 236 equal to the stored specific humidity while the counter value 224 is greater than the predetermined value.

In response to the counter value 224 transitioning from greater than the predetermined value to less than the predetermined value, the specific humidity module 232 may set the second specific humidity 236 equal to the first specific humidity 208. The specific humidity module 232 continues to set the second specific humidity 236 equal to the first specific humidity 208 while the counter value 224 is less than the predetermined value. In various implementations, the specific humidity module 232 may begin setting the second specific humidity 236 equal to the first specific humidity 208 when the counter value 224 becomes less than a second predetermined value. This may allow different periods to be used for transitions from using the first specific humidity 208 and for transitions to using the first specific humidity 208.

The specific humidity module 232 also stores the third specific humidity 242 in response to a shutdown of the engine 102. Shut down of the engine 102 may be indicated, for example, by the ignition state 178 or the presence of one or more other conditions, such as the engine speed being equal to zero.

Water vapor produced by the engine 102 may be measured by the humidity sensor 150 for a predetermined period after a shutdown of the engine 102. The specific humidity at the humidity sensor 150 may reach approximately equilibrium with the specific humidity of ambient air once the predetermined period has passed after a shutdown of the engine 102.

An engine off period 248 may refer to a period between a time when the engine 102 was last (most recently) shut down and a present time. A timer module 252 may reset the engine off period 248 in response to a shutdown of the engine 102 and increase the engine off period 248 as time passes after the shutdown of the engine 102. In various implementations, a timestamp may be generated in response to a shutdown of the engine 102, and the engine off period 248 may be determined based on a period between the timestamp and the present time.

When the engine 102 is started, the specific humidity module 232 may determine whether to set the second specific humidity 236 based on the first specific humidity 208 or the stored specific humidity based on the engine off period 248. The specific humidity module 232 may set the second specific humidity 236 equal to the stored specific humidity (i.e., the specific humidity stored in response to the last shut down of the engine 102) when the engine off period 248 is less than the predetermined period. Conversely, the specific humidity module 232 may set the second specific humidity 236 equal to the first specific humidity 208 when the engine off period 248 is greater than the predetermined period. For example only, the predetermined period may be approximately 3 hours, approximately 4 hours, or another suitable period.

In this manner, if the engine 102 is shut down for at least the predetermined period, the first specific humidity 208 will be used after the engine 102 is started. If the engine 102 is shut down for less than the predetermined period, water vapor produced by the engine 102 may affect the output of the humidity sensor 150, so the stored specific humidity may be used after the engine 102 is started. The stored specific humidity may be used, for example, until airflow into the engine 102 not low for a predetermined period after the engine 102 is started.

The parameter control module 170 controls engine operating parameters based on an engine torque request 256. A torque request determination module 260 may determine the engine torque request 256 based on one or more of the driver inputs 174 and/or one or more other suitable inputs. The parameter control module 170 controls one or more engine operating parameters further based on the third specific humidity 242. For example, the parameter control module 170 may control intake and/or exhaust camshaft phasing, spark timing, fuel injection, and other engine operating parameters based on the third specific humidity 242.

Figure 3:
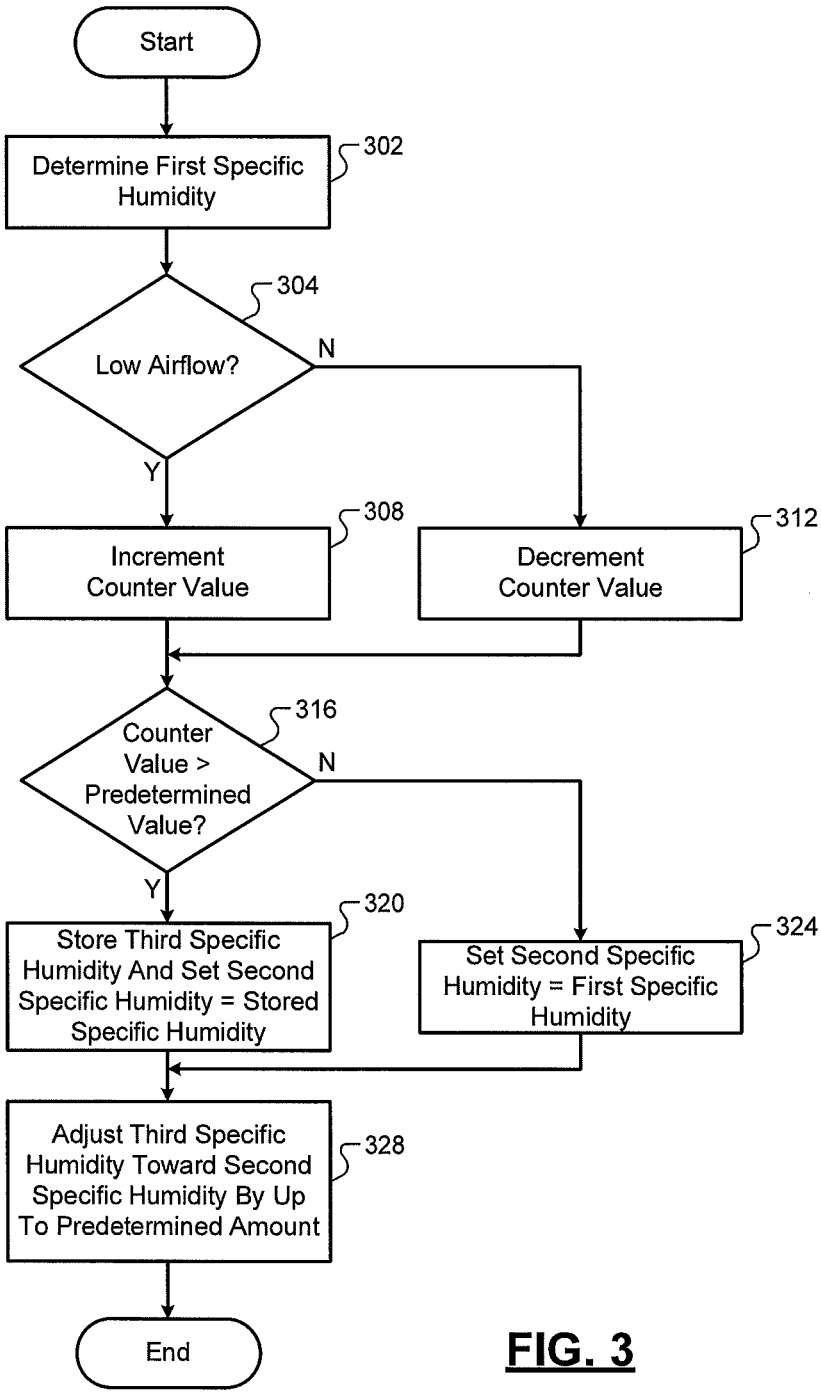
FIG. 3 is a flowchart depicting an example method of determining specific humidity for use in controlling one or more engine operating parameters.

Referring now to FIG. 3, a flowchart depicting an example method of determining specific humidity for use in controlling engine operating parameters is presented. Control may begin with 302 where control determines the first specific humidity 208. Control determines the first specific humidity 208 based on the relative humidity 212 measured using the humidity sensor 150.

At 304, control determines whether airflow into the engine 102 is low. Control may determine whether the MAF 228 is less than the predetermined flowrate at 304. If true, control may increment the counter value 224 at 308 and continue with 316. If false, control may decrement the counter value 224 at 312 and continue with 316.

At 316, control determines whether the counter value 224 is greater than the predetermined value. When the counter value 224 transitions from less than the predetermined value to greater than the predetermined value, control stores the third specific humidity 242. If true at 316, control sets the second specific humidity 236 equal to the stored specific humidity at 320, and control continues to 328. If false, control sets the second specific humidity 236 equal to the first specific humidity 208 at 324, and control continues to 328. The predetermined value may correspond to a period between a first time and a second time when water vapor produced by the engine 102 is reflected in the relative humidity 212 due to the MAF 228 being less than the predetermined flowrate from the first time until the second time.

At 328, control adjusts the third specific humidity 242 toward the second specific humidity 236 by up to the predetermined amount. In other words, control applies the filter to the second specific humidity 236 to produce the third specific humidity 242 at 328. One or more engine operating parameters can be controlled/adjusted based on the third specific humidity 242. For example, spark timing, intake and/or exhaust cam phasing, fuel injection, and/or one or more other engine operating parameters can be controlled/adjusted based on the third specific humidity 242. Control may then end. While control is shown and discussed as ending, FIG. 3 may be illustrative of one control loop and control may return to 302.

Figure 4:
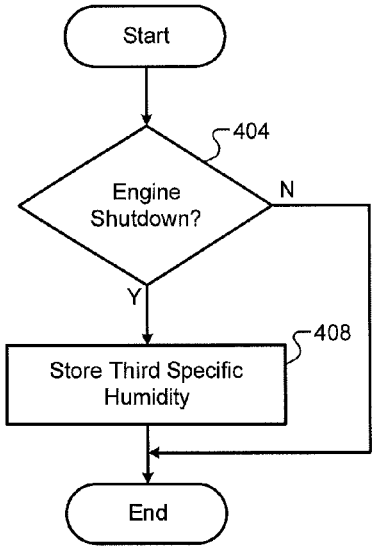
FIG. 4 is a flowchart depicting an example method of storing a specific humidity for use after an engine startup.

Referring now to FIG. 4, a flowchart depicting an example method of storing a specific humidity for use after an engine startup is presented. Control may begin with 404 where control determines whether the engine 102 is shut down or is being shut down. If true, control stores the third specific humidity 242 at 408, and control may end. If false, control may end. While control is shown and discussed as ending, FIG. 4 may be illustrative of one control loop and control may return to 404.

Figure 5:
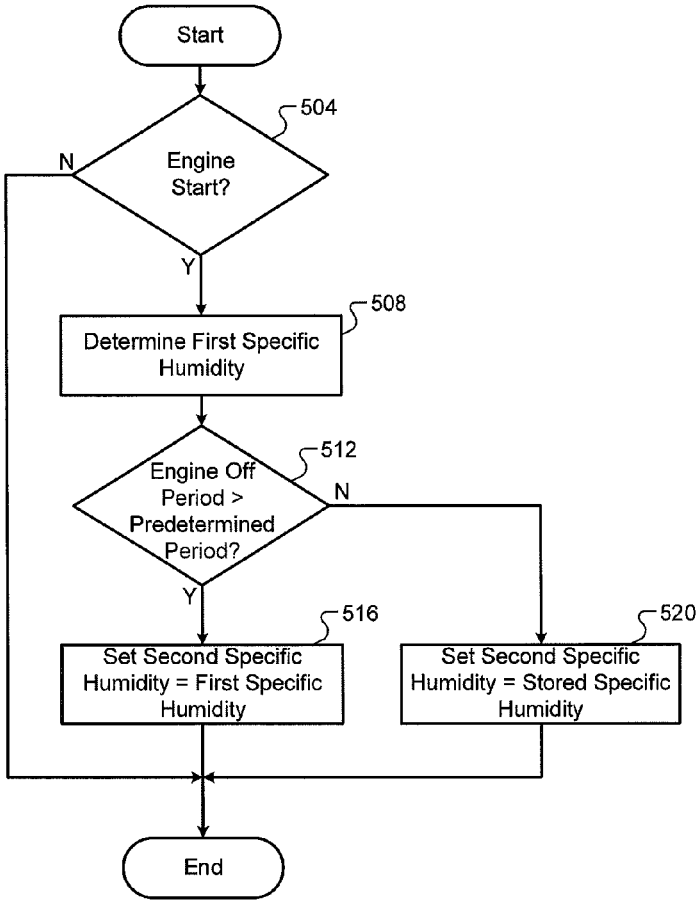
FIG. 5 is a flowchart depicting an example method of determining a specific humidity after engine startup.

Referring now to FIG. 5, a flowchart depicting an example method of determining a specific humidity after engine startup is presented. Control may begin with 504 where control determines whether to start the engine 102 or whether the engine 102 is starting. If true, control may continue with 508. If false, control may end.

At 508, control determines the first specific humidity 208. Control determines the first specific humidity 208 based on the relative humidity 212 measured using the humidity sensor 150. Control determines whether the engine off period 248 is greater than the predetermined period at 512. If true, control continues with 516; if false, control continues with 520. For example only, the predetermined period may be approximately 3-4 hours.

At 516, control sets the second specific humidity 236 equal to the first specific humidity 208. In this manner, when the period between the last engine shutdown and the present time is greater than the predetermined period, control uses the first specific humidity 208 after the engine startup. At 520, control sets the second specific humidity 236 equal to the stored specific humidity. The stored specific humidity is the third specific humidity 242 that was stored in response to the last shutdown of the engine 102. In this manner, when the period between the last engine shutdown and the present time is less than the predetermined period (when water vapor produced by the engine 102 could affect the output of the humidity sensor 150), stored specific humidity is used after engine startup. When the engine off period 248 is less than the predetermined period, the stored specific humidity may be used, for example, until airflow into the engine 102 is not low for a predetermined period after the engine startup.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

What is claimed is:

1. A system for a vehicle, comprising:

a humidity determination module that determines a first specific humidity of air based on a relative humidity of the air measured by a humidity sensor in an intake system of the vehicle;

a specific humidity module that sets a second specific humidity of the air equal to one of the first specific humidity and a predetermined specific humidity of the air in response to a comparison of a mass air flowrate (MAF) into an engine and a predetermined flowrate; and a parameter control module that controls at least one operating parameter of an engine based on the second specific humidity.

2. The system of claim 1 wherein the specific humidity module selectively sets the second specific humidity equal to the first specific humidity in response to a determination that the MAF is greater than the predetermined flowrate.

3. The system of claim 1 wherein the specific humidity module selectively sets the second specific humidity equal to the predetermined specific humidity in response to a determination that the MAF is less than the predetermined flowrate.

4. The system of claim 3 further comprising a counter module that increments a counter value in response to a determination that the MAF is less than the predetermined flowrate, wherein the specific humidity module sets the second specific humidity equal to one of the first specific humidity and the predetermined specific humidity based on the counter value.

5. The system of claim 4 wherein the specific humidity module sets the second specific humidity equal to the first specific humidity when the counter value is less than a predetermined value.

6. The system of claim 5 wherein the specific humidity module sets the second specific humidity equal to the predetermined specific humidity when the counter value is greater than the predetermined value.

7. The system of claim 1 wherein the humidity determination module determines the first specific humidity as a function of the relative humidity, an air temperature at the humidity sensor, and a pressure at the humidity sensor.

8. The system of claim 1 further comprising a filter module that applies a filter to the second specific humidity to generate a third specific humidity of the air, wherein the specific humidity module selectively sets the predetermined specific humidity equal to the third specific humidity in response to a determination that the MAF is less than the predetermined flowrate.

9. The system of claim 1 further comprising a filter module that applies a filter to the second specific humidity to generate a third specific humidity of the air, wherein the specific humidity module sets the predetermined specific humidity equal to the third specific humidity in response to a shutdown of the engine, and wherein, in response to a startup of the engine, the specific humidity module:

selects one of the first specific humidity and the predetermined specific humidity based on a period between the shutdown of the engine and the startup of the engine; and sets the second specific humidity equal to the selected one of the first specific humidity and the predetermined specific humidity.

10. The system of claim 9 wherein, in response to the startup of the engine, the specific humidity module:

selects the first specific humidity when the period is greater than a predetermined period; and selects the predetermined specific humidity when the period is less than the predetermined period.

11. A method for a vehicle, comprising:

determining a first specific humidity of air based on a relative humidity of the air measured by a humidity sensor in an intake system of the vehicle;

setting a second specific humidity of the air equal to one of the first specific humidity and a predetermined specific humidity of the air in response to a comparison of a mass air flowrate (MAF) into an engine and a predetermined flowrate; and controlling at least one operating parameter of an engine based on the second specific humidity.

12. The method of claim 11 further comprising selectively setting the second specific humidity equal to the first specific humidity in response to a determination that the MAF is greater than the predetermined flowrate.

13. The method of claim 11 further comprising selectively setting the second specific humidity equal to the predetermined specific humidity in response to a determination that the MAF is less than the predetermined flowrate.

14. The method of claim 13 further comprising:

incrementing a counter value in response to a determination that the MAF is less than the predetermined flowrate; and setting the second specific humidity equal to one of the first specific humidity and the predetermined specific humidity based on the counter value.

15. The method of claim 14 further comprising setting the second specific humidity equal to the first specific humidity when the counter value is less than a predetermined value.

16. The method of claim 15 further comprising setting the second specific humidity equal to the predetermined specific humidity when the counter value is greater than the predetermined value.

17. The method of claim 11 further comprising determining the first specific humidity as a function of the relative humidity, an air temperature at the humidity sensor, and a pressure at the humidity sensor.

18. The method of claim 11 further comprising:

applying a filter to the second specific humidity to generate a third specific humidity of the air; and selectively setting the predetermined specific humidity equal to the third specific humidity in response to a determination that the MAF is less than the predetermined flowrate.

19. The method of claim 11 further comprising:

applying a filter to the second specific humidity to generate a third specific humidity of the air;

setting the predetermined specific humidity equal to the third specific humidity in response to a shutdown of the engine; and, in response to a startup of the engine:

selecting one of the first specific humidity and the predetermined specific humidity based on a period between the shutdown of the engine and the startup of the engine; and setting the second specific humidity equal to the selected one of the first specific humidity and the predetermined specific humidity.

20. The method of claim 19 further comprising, in response to the startup of the engine:

selecting the first specific humidity when the period is greater than a predetermined period; and selecting the predetermined specific humidity when the period is less than the predetermined period.

* * * * *